US009039493B2

(12) United States Patent
Borsch

(10) Patent No.: US 9,039,493 B2
(45) **Date of Patent: *May 26, 2015**

(54) BLADE SHARPENING SYSTEM FOR MULTIPLE BLADE SHAPES

(71) Applicant: Michael G. Borsch, Jacobsburg, OH (US)

(72) Inventor: Michael G. Borsch, Jacobsburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/065,547

(22) Filed: Oct. 29, 2013

(65) Prior Publication Data

US 2014/0154957 A1 Jun. 5, 2014

Related U.S. Application Data

(63) Continuation of application No. 12/958,720, filed on Dec. 2, 2010, now Pat. No. 8,597,083.

(60) Provisional application No. 61/283,552, filed on Dec. 3, 2009.

(51) Int. Cl.

| | |
|---|---|
| ***B24B 37/00*** | (2012.01) |
| ***B24B 3/36*** | (2006.01) |
| ***B24B 3/52*** | (2006.01) |
| ***B24B 41/06*** | (2012.01) |

(52) U.S. Cl.

CPC ... *B24B 3/36* (2013.01); *B24B 3/52* (2013.01); *B24B 41/06* (2013.01); *B24B 41/066* (2013.01)

(58) Field of Classification Search

CPC ..... B24B 9/16; B24B 19/226; B24B 23/08; B24B 9/12; B24B 41/06

USPC ..... 451/278, 293, 231, 224, 377, 371, 280, 451/45, 41, 180, 349

See application file for complete search history.

(56) References Cited

U.S. PATENT DOCUMENTS

| | | | |
|---|---|---|---|
| 282,364 | A | 7/1883 | Pieckering |
| 332,187 | A | 12/1885 | Comstock |
| 448,616 | A | 3/1891 | Hudson |
| 502,459 | A | 8/1893 | Ginn |
| 747,756 | A | 12/1903 | Oepinger |
| 877,199 | A | 1/1908 | Joy |
| 886,754 | A | 5/1908 | Bastan et al. |
| 905,638 | A | 12/1908 | Beust |
| 970,227 | A | 9/1910 | Homan |
| 1,030,662 | A | 6/1912 | Johnson |
| 1,256,034 | A | 2/1918 | Notter |
| 1,439,889 | A | 12/1922 | Hemming et al. |
| 1,806,234 | A | 5/1931 | Boyd |
| 1,832,968 | A | 11/1931 | Armey |
| 2,163,425 | A | 6/1939 | Emerson |
| 2,305,230 | A | 12/1942 | Allen |
| 2,334,238 | A | 11/1943 | Baldenhofer |

(Continued)

FOREIGN PATENT DOCUMENTS

EP 27149 A1 4/1981

*Primary Examiner* — George Nguyen

(74) *Attorney, Agent, or Firm* — Robert G. Lev

(57) ABSTRACT

A blade sharpening system using the interior surface of a grinding wheel against which a blade is drawn along its entire length for sharpening. The sharpening system includes a blade holding configuration having multiple hinged arms. A cam operating between two of the hinged arms serves to alter the angle of incidence between the blade and the grinding wheel as the blade is drawn across the grinding wheel. The result is that a wide variety of different blade configurations can be easily accommodated by the sharpening system.

20 Claims, 6 Drawing Sheets

(56) References Cited

U.S. PATENT DOCUMENTS

| | | | |
|---|---|---|---|
| 2,578,309 | A | 12/1951 | Kroczek |
| 2,723,515 | A | 11/1955 | Stuck |
| 2,753,666 | A | 7/1956 | Sasse |
| 2,922,263 | A | 1/1960 | Bogart, Sr. |
| 3,057,122 | A | 10/1962 | Ellsworth et al. |
| 3,200,540 | A | 8/1965 | Aime |
| 3,490,884 | A | 1/1970 | Brierley |
| 3,546,819 | A | 12/1970 | Campbell |
| 3,733,751 | A | 5/1973 | Williams |
| 3,879,899 | A | 4/1975 | Ribar |
| 3,964,349 | A | 6/1976 | Von Arnauld et al. |
| 4,528,778 | A | 7/1985 | Wolff |
| 4,916,866 | A | 4/1990 | Bernard et al. |
| 5,133,157 | A | 7/1992 | Hulskotte |
| 5,157,870 | A | 10/1992 | Pike |
| 5,941,763 | A | 8/1999 | Kaye |
| 7,465,220 | B1 | 12/2008 | Wolff |
| 7,959,494 | B1 | 6/2011 | Pietrzak |
| 8,092,279 | B2 | 1/2012 | Parrish |
| 8,597,083 | B2 * | 12/2013 | Borsch ..... 451/278 |

* cited by examiner

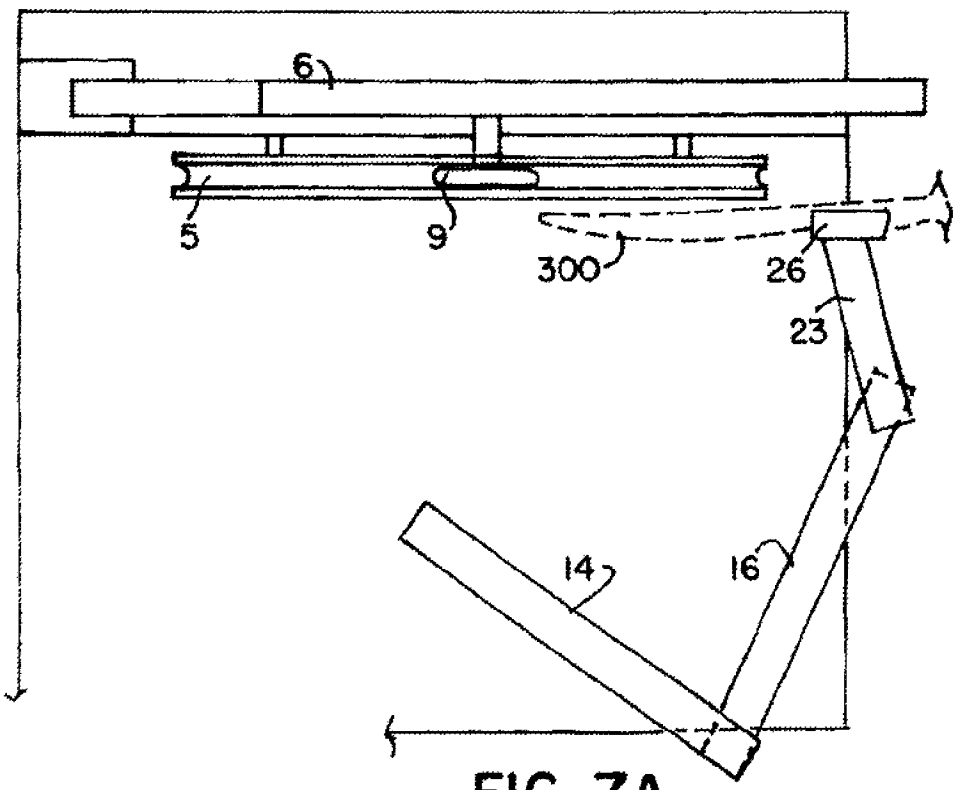
FIG. 7A
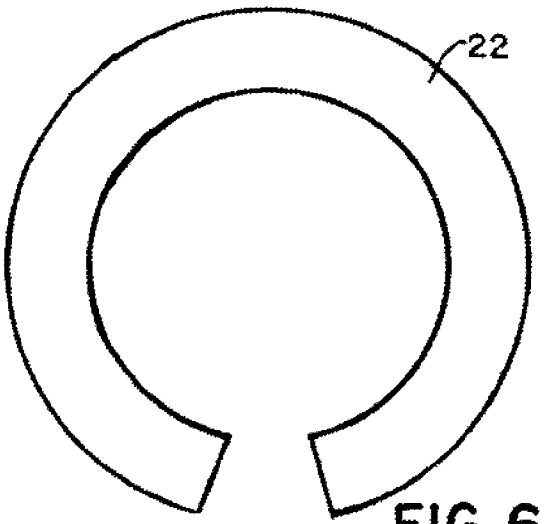
FIG. 6A
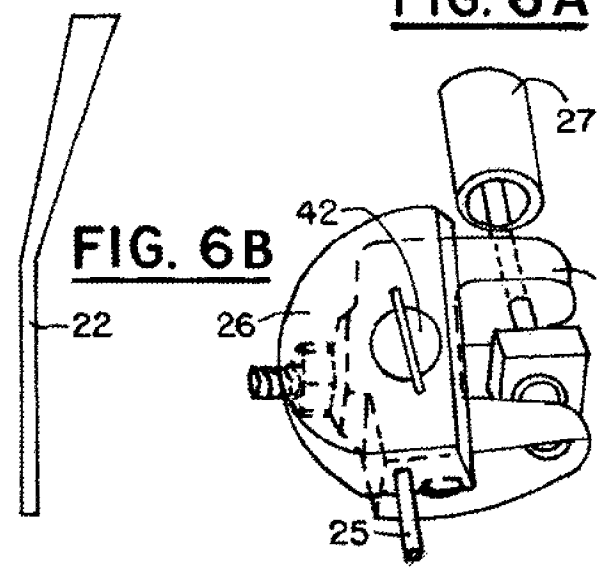
FIG. 7B
FIG. 6B

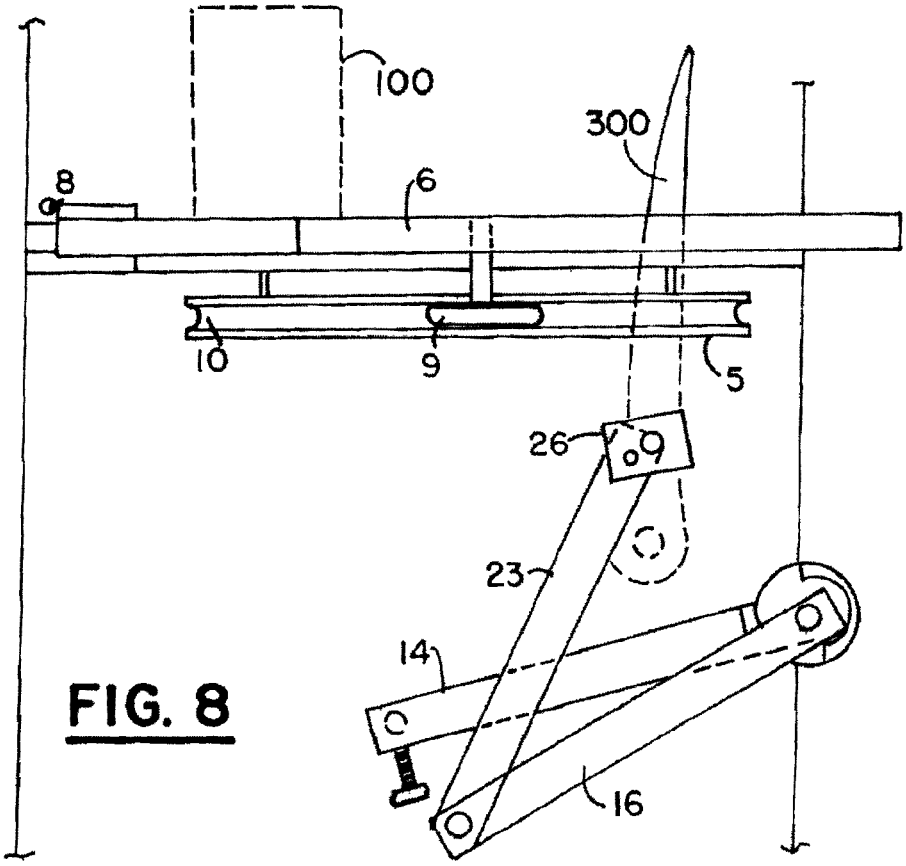
FIG. 8
FIG. 9
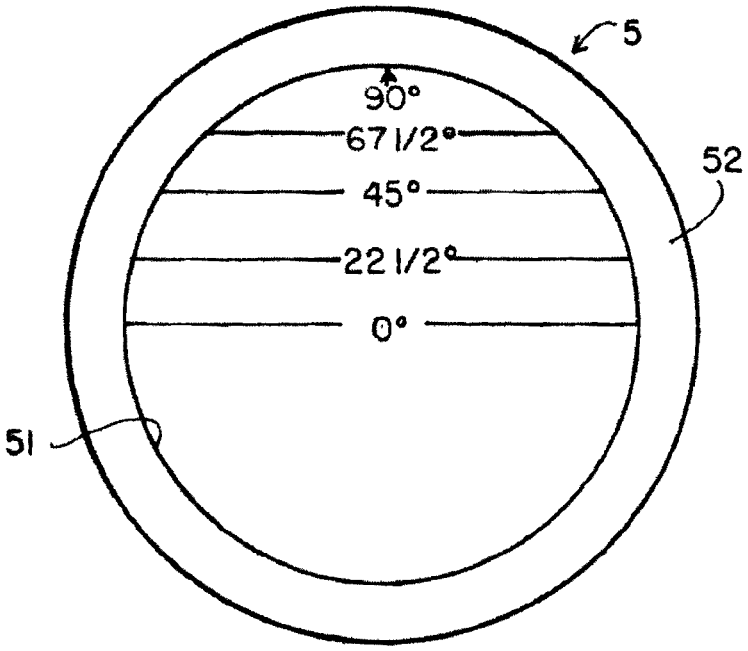

FIG. 10
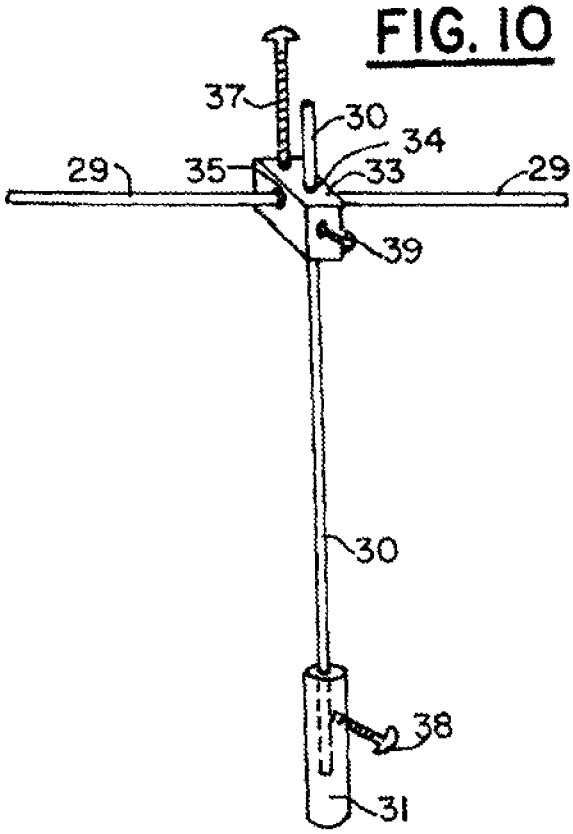
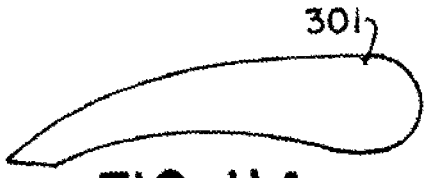
FIG. 11A
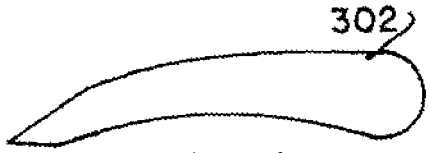
FIG. 11B
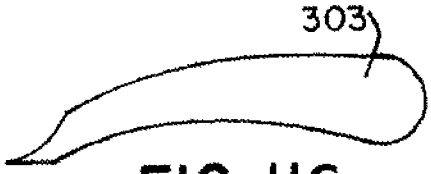
FIG. 11C

BLADE SHARPENING SYSTEM FOR MULTIPLE BLADE SHAPES

PRIORITY INFORMATION

The present application claims priority to U.S. Provisional Application No. 61/283,552 filed on Dec. 3, 2009, making reference to same herein in its entirety.

FIELD OF THE INVENTION

The present invention relates generally to sharpening devices for knives, shears and other blades. In particular, the present invention is directed to a sharpening system for both convex and beveled edges, with varying angles of the edge along the length of the blade.

BACKGROUND OF THE INVENTION

There are currently a wide variety of different blade types used on a wide variety of different cutting implements. Depending upon the implement used and the duty cycle that it must endure, periodic sharpening is required. A sharpening system and process is often adapted to the particular type of blade used.

One major drawback in the art of sharpening blades is that there is a certain amount of deterioration of the blade caused by the sharpening process. Over time, this can either destroy or alter the blade's fundamental characteristics. Accordingly, the precision of the sharpening device and sharpening process, (as well as the duty cycle of the blade) become critical to the life of the blade.

One type of blade that is subject to intense duty cycles, and subsequently frequent sharpening programs, is found in shears/scissors, especially those used for cutting hair. There are three types of blade typically found in barber shears/scissors, as depicted in FIG. 11. These include the beveled edge, the hollow ground edge, and the convex edge. There are also a wide variety of different systems and techniques for sharpening such blades. A number of these are disclosed in the following U.S. Pat. No. 3,733,751 to Williams; U.S. Pat. No. 2,753,666 to Sasse; U.S. Pat. No. 1,832,968 to Armey; U.S. Pat. No. 1,806,234 to Boyd; U.S. Pat. No. 5,941,763 to Kaye; U.S. Pat. No. 7,465,220 to Wolff; U.S. Pat. No. 970,227 to Homan; U.S. Pat. No. 3,879,899 to Ribar; and U.S. Pat. No. 4,528,778 to Wolff. All of these patents are incorporated herein by reference.

Practice indicates that convex blades are preferred for scissors or shears, especially those used for cutting human hair. Because of the duty cycle for such shears/scissors, frequent sharpening is necessary. Unfortunately, the sharpening of convex blades, such as those preferred in barbering applications, is the most difficult to accomplish. This type of blade is especially vulnerable to degradation or changes in shape during the sharpening process.

Currently, a number of approaches to the sharpening of convex edges, such as those that are used in barber shears exist. The first of these is to maintain the convex edge along the length of the blade by rolling the edge on the outside of a grinding wheel. This technique requires that several passes be made, in which the angle to the sharpening wheel is changed for each pass. The result is usually a series of hollow ground cuts that look similar to a convex edge, but in reality, differs slightly (as indicated in the comparison of edges depicted in FIG. 11). Usually, the last pass on the outer-most cutting edge, results in a hollow ground edge. This undesirable result is very difficult to avoid.

There are conventional sharpening devices that use a flat disk and a clamp to carry out a process of rolling the blade against the flat disk to create a convex edge. However, this approach has a number of problems. Firstly, if the blade is not lifted at exactly the right time (within a millisecond of the precise time required) during the pass, a "micro-bevel" is placed on the outside of the cutting edge. This is a deviation from the true convex edge (as depicted in FIG. 11).

Another problem with conventional sharpening process for shears/scissors is that many scissor manufacturers have started to coat the outside of the blade with electro-plated metals to provide certain blade characteristics. Unfortunately, when conducting the conventional process of rolling the blade during sharpening, the plating can be moved or damaged, resulting in an unsightly finish on the scissors, as well resulting in a failure to obtain a true convex edge.

To complicate matters, such problems are often exaggerated by some scissor designs that include a changing angle from the back of the blade to the tip. This initial design is accomplished in the factory by uniformly sharpening the scissors blades in the manufacturing plant and then bending them to the final curve (which includes the varying edge angle along the length of the blade). The result of this particular design is that the sharpening process is rendered extremely difficult, especially in view of the need to not alter or damage the blade.

Currently, approximately 90% of the barber/beauty shear manufacturing industry production is directed to convex edges. Further, approximately of all barber/beauty shears or scissors are coated with a colored finish. In order to address such products, conventional sharpening systems have become quite complex, and very time consuming. For example, a conventional sharpening process for a convex edge can take as many as four or five abrasive wheel changes (and many passes) for each blade. Even with extreme care and expenditure of time, damage or unfavorable deformation of the blade can still take place with conventional systems.

Accordingly, a need exists for a sharpening system, especially a sharpening system for shears or scissors, that can quickly sharpen a convex blade along its entire length without damaging or deforming the blade from its desired shape, or cover. An improved sharpening system would also be relatively error free while conducting rapid sharpening of both convex and bevel edged shears.

SUMMARY OF THE INVENTION

Accordingly, it is a primary object of the present invention to provide a sharpening system and method that overcome the limitations of conventional blade sharpening systems.

It is an ongoing object of the present invention to provide a sharpening system that can sharpen both convex blades and bevel edged blades without causing damage or unfavorable deformation to any part of the blade surface.

It is another object of the present invention to provide a sharpening system that operates very quickly without causing unfavorable changes to the blade.

It is a further object of the present invention to provide a sharpening system that easily accommodates accurate sharpening along the entire length of the blade.

It is an additional object of the present invention to provide a sharpening system that automatically accommodates changes in the shape of the blade along its length.

It is again a further an object of the present invention to provide a sharpening system that is equally efficacious for both convex and bevel-edged blades.

It is yet a further object of the present invention to provide a sharpening system that allows for exact sharpening angles to be set and transferred to the blades that are being sharpened.

It is still an additional object of the present invention to provide a sharpening system in which a true convex blade can be sharpened in a single pass, while accommodating a changing edge angle along the length of the blade.

It is yet a further object of the present invention to provide a sharpening system which can adjust the angle to a greater or lesser degree from one part of a blade to another.

It is again another object of the present invention to provide a sharpening system which facilitates easy operation on virtually any type of blade.

These and other goals and objects of the present invention are accomplished by a sharpening system which places an edge to be sharpened on the interior diameter of a grinding wheel.

BRIEF DESCRIPTION OF DRAWINGS

FIG. 6A is a top view of a cam shim of the present invention.

FIG. 6B is a side view of the cam shim of FIG. 6A.

FIG. 7A is a top view of the grinding wheel and blade holding mechanism of the present invention, in a first position.

FIG. 7B is a perspective view of the blade holding clamp used to hold the blade in the arrangement of FIG. 7A.

FIG. 8 is a top view of the system of the present invention with the arm assembly holding a blade in position to be sharpened.

FIG. 9 is a side view of the grinding wheel used with the present invention.

FIG. 10 is an exploded perspective view of a tool rest used with the present invention.

FIG. 11A is a depiction of the cross-sectional shape of one common blade type.

FIG. 11B is a depiction of the cross-sectional shape of a second common blade type.

FIG. 11C is a depiction of the cross-sectional shape of a third common blade type.

DETAILED DESCRIPTION OF PREFERRED EMBODIMENTS

Figure 1:
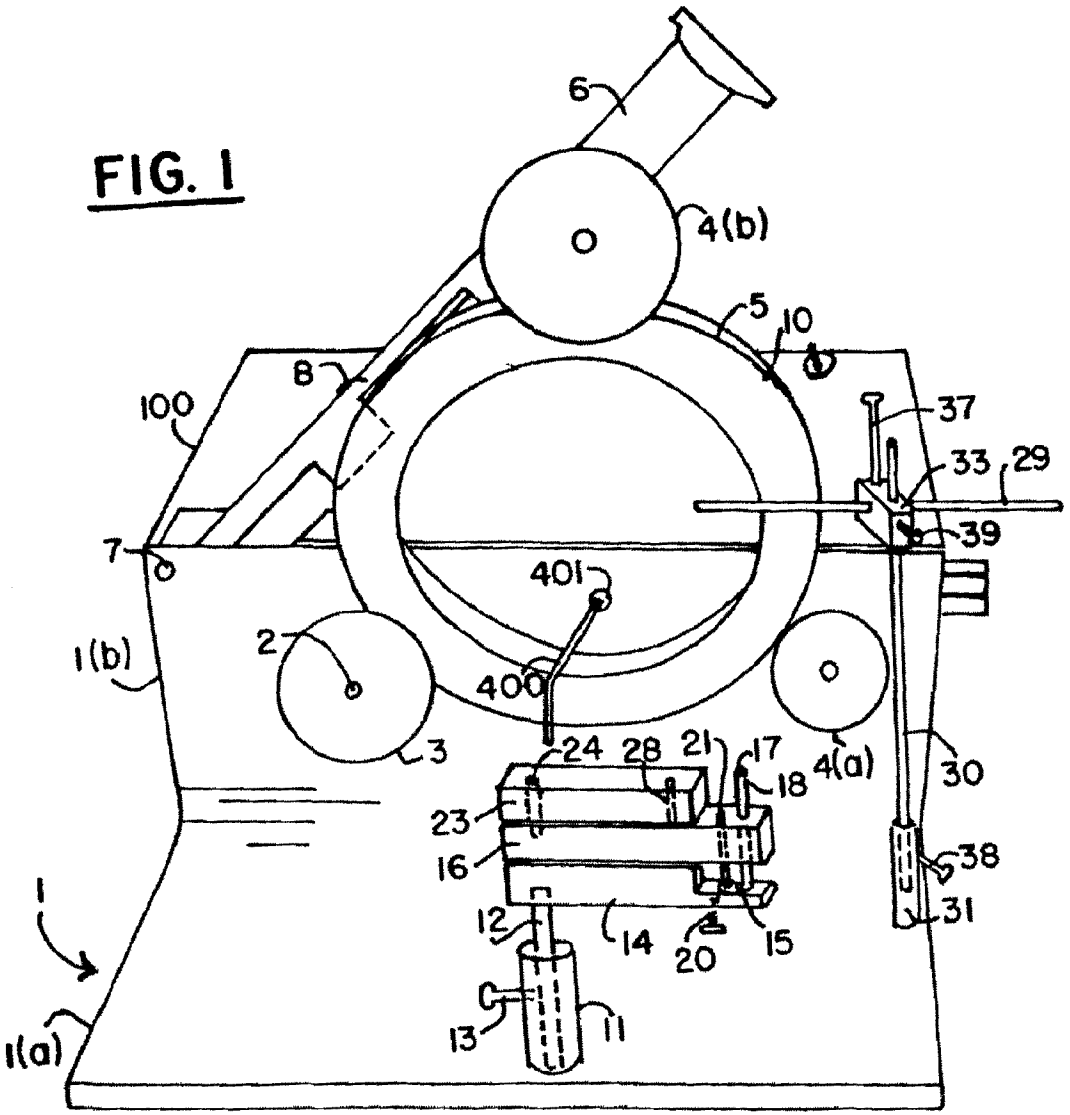
FIG. 1 is a front view of the overall grinding system of the present invention.
Figure 2A:
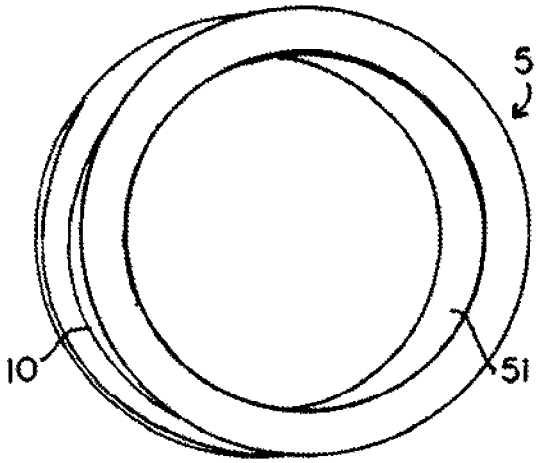
FIG. 2A is a perspective view of a grinding wheel used with the present invention.
Figure 2B:
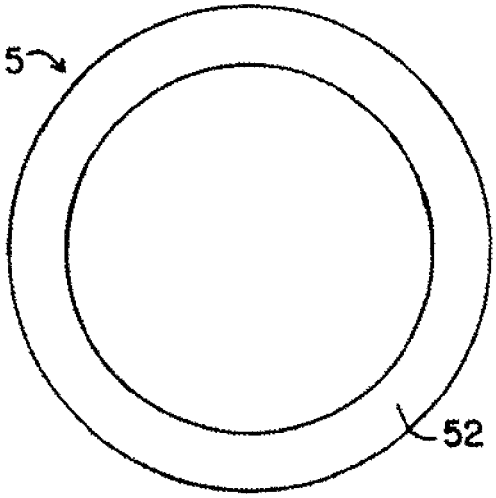
FIG. 2B is a front view of the grinding wheel of FIG. 2A.
Figure 2C:
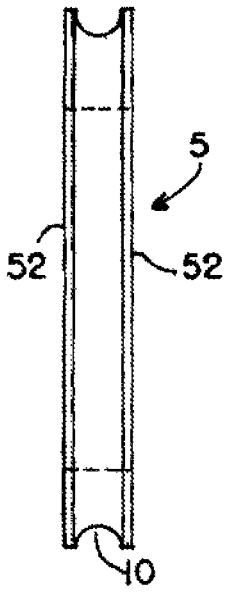
FIG. 2C is a side view of the grinding wheel of FIGS. 2A and 2B.

The present invention is a sharpening device which sharpens both convex and beveled edges and has the ability to create a graduated angle along the length of the blade edge. The basic system, as depicted in FIG. 1, includes a solid, stable supporting frame for a drive motor, idler wheels and clamping fixtures. The general layout of the present invention is very similar to many conventional devices, as disclosed in the patents cited supra, and incorporated by reference. The difference in the present invention, as will be described below, lies in the refinements for the placement and holding of the blade to be sharpened, and the parts of the grinding wheel to be used. Further, a number of additional novel features have been added to the overall system to enhance the speed and ease of operation for the present inventive system.

In particular, the abrasive surface of grinding wheel 5 is found on the inner circumference 51, rather than on the outer circumference as is done conventionally. The outer circumference of grinding wheel 5 contains a circumferential indent or groove 10. The circumferential groove 10 is used to accommodate driving and stabilization devices as will be described supra. The use of the novel blade holding and guide mechanism with the novel grinding wheel 5 is also described supra. The particular configuration of grinding wheel 5 facilitates a number of desirable features.

For example, the grinding, honing and polishing wheels 5 are arranged for quick changes to facilitate the sharpening of a wide variety of different blades. The drive motor (not shown) has a reversing switch as well as a speed control, thereby allowing for very precisely controlled metal removal during the sharpening process. The mounted motor has a drive tire 3 on the shaft 2 and a triangular configuration of idler wheels 4(*a*), 4(*b*) (all located in groove 10) to maintain speed control and stability. The top idler wheel 4(*b*) is spring loaded to allow the grinding, honing and polishing wheels 5 to be quickly changed.

A tri-part arm assembly (FIG. 3) and clamping devices allow for exact angles to be set and transferred to the blade being sharpened. A cam 15 between the arms allows the grinding angle of the blade with respect to the grinding wheel to increase or decrease as the blade moves along its length. The entire arrangement is configured for speed and precision.

The details of the present invention are depicted in FIGS. 1-10. The present device includes an L-shaped base 1, positioned so that one leg 1(*a*) of the base is horizontal and the other leg 1(*b*) is vertical. A motor (not shown) is mounted in enclosure 100 and has a drive shaft 2 coming through the vertical leg 1(*b*) of the base and facing the horizontal leg 1(*b*) of the base. A drive tire 3 is mounted to the shaft 2. A first idler tire 4(*a*) is mounted to the vertical leg 1(*b*) in the same horizontal and vertical plane as the drive tire 3. The size and exact positioning of the total arrangement is determined by the size of drive tire 3, idler tires 4(*a*), 4(*b*) and the outside diameter of the abrasive or grinding wheel 5.

A guide arm 6 is attached to the vertical leg 1(*b*) of the base in such a manner that the face of the arm 6 is in the same vertical plane as the face of the vertical leg 1(*b*) of the base 1. Guide arm 6 has a pivot connection 7 that allows for a torsion spring 8 to place a force downward in the direction of the horizontal leg of the base 1. An idler tire 4(*b*) is attached to the guide arm 6 in such a position so that when the guide arm 6 is lifted, and the abrasive or grinding wheel 5 is inserted, it will form an equilateral triangle (with idler tires 4(*a*), 4(*b*) and drive tire 3) over the outside of the abrasive wheel 5.

The abrasive wheel 5 is arranged with the annular, circumferential indentation or groove 10 formed between sidewalls 52 of the abrasive wheel 5. The indentation 10 is specifically sized to accommodate the drive tire 3 and idler tires 4(*a*), 4(*b*). The torsion spring 8 on the guide arm 6 holds the drive tire 3 annular indentation 10. This configuration allows the abrasive or grinding wheel 5 to be held in place and to spin freely and be rotated easily by the drive tire 3. This arrangement allows for quick change of the abrasive wheel 5 by simply lifting guide arm 6 and inserting a different abrasive wheel 5 into the configuration.

It is crucial that this arrangement allows for the center of the abrasive wheel 5 and its inner circumference surface 51 to be free of obstruction so that a blade 300 can be presented to the inside surface 51 of the abrasive wheel 5 for sharpening. The blade holding the control arrangement in FIG. 3 facilitates this.

Figure 3:
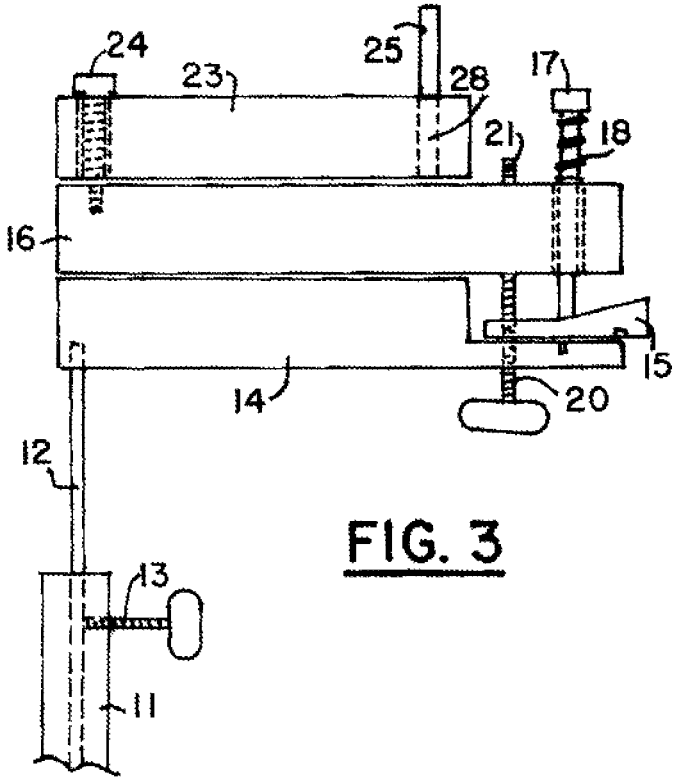
FIG. 3 is a front view of the arm assembly of the present invention.

A special tri-part arrangement of mutually hinged arms 14, 16, 23 (FIG. 3) is mounted on the horizontal leg 1(*a*) of base 1 to hold the blade 300 to be sharpened, and adjust it with respect to the interior surface 51 of grinding wheel 5. The tri-part arm arrangement (14, 16, 23) is one novel aspect of the present invention since it facilitates the novel aspect of placing the blade 300 on the interior surface 51 of the grinding wheel 5. The horizontal leg 1(*a*) of base 1 provides a stable base for the operation for the tri-part arm configuration 14, 16, 23, as depicted in FIG. 3.

Figure 4B:
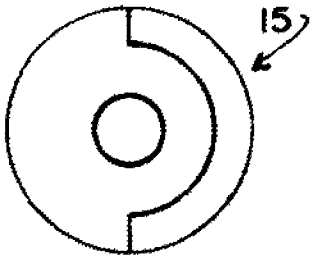
FIG. 4B is a top view of the cam of FIG. 4A.
Figure 4D:
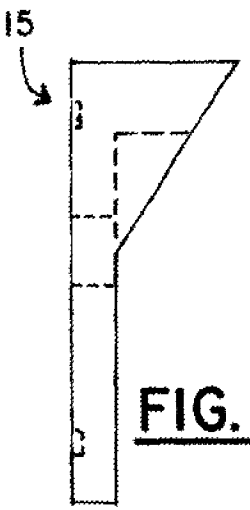
FIG. 4D is a side view of the cam of FIGS. 4A-4C.
Figure 4A:
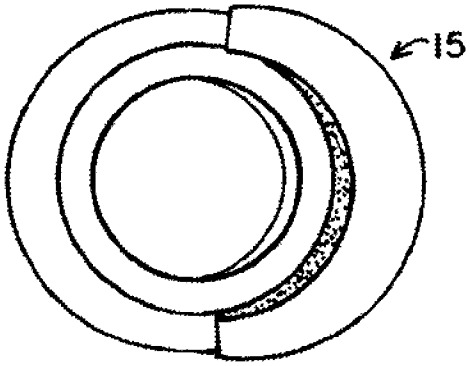
FIG. 4A is a perspective view of a cam used as part of the present invention.
Figure 4C:
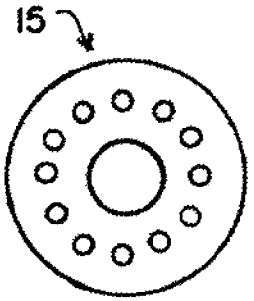
FIG. 4C is a bottom view of the cam of FIGS. 4A and 4B.

A post 11 is attached to the horizontal leg 1(*a*) of the base 1. Post 11 has a hole in the center so that support pin 12 can be inserted into it. A locking mechanism 13 such as thumb screw will allow support pin 12 to be raised and lowered as well as turned and locked into place. On top of support pin 12 is the arrangement of three arms 14, 16, and 23, and two pivot joints, as depicted in FIG. 3. The lowest arm 14 is attached to the top of the pin 12 at one end. On the other end arm 14 is a half cam 15, as depicted in FIGS. 4A-4C. The interface of cam 15 and arms 14 and 16 is depicted in FIG. 5.

Figure 5:
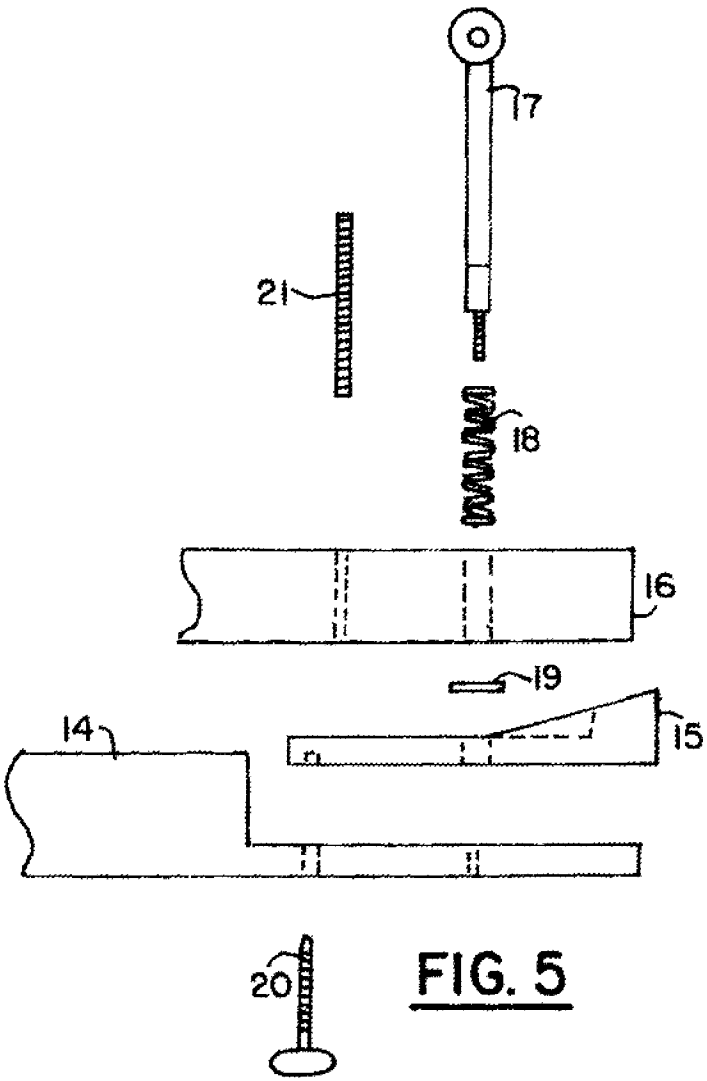
FIG. 5 is an exploded side view depicting details of the cam adjustment assembly of the present invention.

The details of the cam and arm interface are best illustrated in the exploded view of FIG. 5. As depicted, a shoulder set bolt 17 is passed through a spring 18 and then through a bore in arm 16. Then a retaining clip 19 is attached to shoulder set bolt 17 in such a position that when the shoulder bolt 17 is then passed through the cam 15 and screwed into a threaded hole in the arm 14, the cam 15 is contained between the retaining ring 19 and the top of the arm 14. No up or down movement of the cam 15 is permitted, but it is able to rotate freely. This is crucial to another aspect of the present invention.

A thumbscrew 20 is threaded through the bottom of arm 14 in such a position that it aligns with a circular arrangement of dents in the bottom of cam 15. This allows cam 15 to be locked into any position with the thumbscrew 20. Threaded screw 21 is threaded into a hole in arm 16 and passes through and rides on the surface of the cam 15, and along with the compressed spring 18 causes the arm 16 to raise and lower, as directed by cam 15, as the arm 16 is rotated.

The amount of vertical adjustment (and thus, the angle at which the blade is placed against the interior surface 51 of grinding wheel 5) over the length of the blade 300 is controlled through the use of magnetic shims 22 (as depicted in FIGS. 6A and 6B). These are applied to the surface of cam 15 to thicken the cam 15. The addition of magnetic shims 22 allows for adjustments from 1° to 6° in change in angle per inch of blade being sharpened. However, different sizes of cams 15 and the shims 22 can be provided to further alter the angle of the blade 300 with respect to the grinding wheel over the entire length of the blade 300.

Arm 16 can be set vertically by turning screw 21 when a shim 22 is added to cam 15 or a new cam is added. The position of arm 16, also effects the position of the upper most arm 23. This is done by means of the tri-arm structure (14, 16, 23) depicted in FIG. 3. The uppermost arm 23 has the pivotal connection with arm 16 by means of a shoulder bolt 24 and a threaded hole in the arm 16.

At the opposite end of arm 23, is a bushing 28, with a bore the same size as pin 25 on the blade holding clamp 26, as depicted in FIG. 7A. Clamp 26 is of a simple C-type design and can hold a blade at any angle from 0°-90°. The blade is locked into place using knob screw assembly 27 in any of the aforementioned positions. This configuration permits clamp 26 to be locked in a plane perpendicular to the inside of the abrasive wheel 5 at a 0° position, such as that depicted in FIG. 9. By raising pin 12 (as depicted in FIG. 3), the angle of the blade can be set and presented to the inside of the abrasive wheel 5.

As the blade is drawn across the inner surface of the abrasive wheel 5, a true convex edge is maintained. The precise angle is maintained using calibration markings on pin 12 to identify specific angle settings. Cam 15 permits the angle to be changed by a specific amount per inch of blade so that the changing shape of the convex blade along the length can be accurately maintained during the sharpening operation.

When conducting the sharpening process, arms 14, 16 and 23 are set in position as depicted in FIG. 8. This position can be reversed for left-handed shears. For a plane beveled edge, the angle would be adjusted using clamp 26, and the edge presented to the edge of the abrasive wheel 5 with arms 14, 26 and 23 in the position as depicted in FIG. 7. There is also a tool rest assembly, as depicted FIG. 10 allowing for the drawing of a curved blade against the inside of the abrasive wheel 5 at a predetermined angle as set by the height of the tool rest 29.

The tool rest assembly, as depicted in FIG. 10 includes a post 30 that is threaded on its lower end. The post 30 is placed into a column support 31 on the base 1 and is adjustable by using thumbscrew 38. Post 30 supports block 33 which has two perpendicular smooth bore holes 34, 35. Post 30 passes through bore 34. Tool rest 29 passes through bore 35. The position of both shaft 30 and tool rest 29 can be adjusted by loosening and tightening screws 39 and 37, respectively. Screw 37 is showing as having gradations to help adjust the height of block 33 along shaft 30. Tool rest 29 can also have gradations (not shown) in order to better place blade 300 at the correct location on the interior 51 of grinding wheel 5. Particular types of blades and particular sharpening angles are achieved by placing the blade at particular points along the inner circumference 51 of grinding wheel 5, as indicated in FIG. 9.

The key advantage of using cam 15 is that a blade 300 can be drawn across the interior 51 of the abrasive wheel 5 in one fluid movement. The height of the blade 300 and thus the grinding angle is changed as required by the action of the cam 15 as arms 16, 23 rotate with respect to each other in each pass. Gradation marks on grind wheel 5, shaft 30, tool rest 29, and screw 37 all help to facilitate grinding accuracy.

The present invention also facilitates quick, exact sharpening for other types of blades. For example, if a uniform angle is desired, the arm (14, 16, 23) is adjusted along pin 12 for 45°, without the benefit of cam 15. The 45° grinding angle would be carried out along the full length of the blade. This would be considered ideal for beveled edges or hollow ground edges, which do not change angle along the length of the blade.

In another example, in a sharpening process used for convex blades, the cam 15 would be engaged at 1.5° per inch of blade (a very common setting) and the arm (14, 16, 23) position on pin 12 is set for a starting angle of 45°. As the blade 300 is drawn along the interior 51 of the abrasive wheel 5, the grinding wheel angle would drop uniformly at a rate equal to 1.5° per inch of blade until the end of the blade was reached. If the blade is four inches long, there would be a 6° less of grind angle, or a change from 45° to 39°. The testing of the present invention indicates that this would be an appropriate setting for the most commonly used beauty/barber shears.

In operation, as depicted in FIG. 8, arms 14, 16 and 23 would be positioned as depicted, for sharpening. Arm 14 would be locked into the position depicted and arms 16 and 23 would rotate with respect to each other. The high point of cam 15 would be set under screw 21. Consequently arms 16, 23 would gradually be lowered as the blade 300 is drawn away from the vertical plane of base 1. The blade 300 would rise back up as it is pushed in the opposite direction.

Because of the precise adjustment to accommodate changes in blade shape, the present invention facilitates rapid sharpening of the blades. Very often, only a single pass is necessary to provide a complete sharpening operation using the system of the present invention. Because of its wide range of adjustments, the present invention can accommodate virtually every type of blade size and configuration. Likewise, a wide variety of blade types can be sharpened by the present invention.

While a number of embodiments have been provided as examples, the present invention is not limited thereto. Rather, the present invention should be understood to encompass any variations, modifications, adaptations, derivations, embodiments, or evolutions that would occur to one skilled in this part once in possession of the teachings of the present invention. Accordingly, the present invention should be construed as being limited only by the following claims.

I claim:

1. A blade sharpening system comprising:

a) a hollow grinding wheel having an interior circumference configured to provide an abrasive sharpening surface, and an external circumference;

b) a blade holding arrangement configured to place a blade at said interior surface of said grinding wheel; and, c) an interface on said exterior circumference to transfer drive power to said hollow grinding wheel.

2. The blade sharpening system of claim 1, wherein said interface of said hollow grinding wheel comprises an outer circumference having a circumferential groove.

3. The blade sharpening system of claim 2, further comprising:

d) a support structure having a horizontal section and a vertical section.

4. The sharpening system of claim 3, further comprising:

e) a drive wheel on said vertical section, so said drive wheel positioned to interface with said circumferential groove of said grinding wheel.

5. The blade sharpening system of claim 4, further comprising:

f) two separate idler wheels arranged on said vertical section, and positioned to interface with said circumferential groove of said grinding wheel.

6. The blade sharpening system of claim 5, wherein said two idler wheels, and said drive wheel form a triangular configuration around said grinding wheel.

7. The blade sharpening system of claim 6, further comprising:

g) a quick release mechanism for said grinding wheel.

8. The blade sharpening system of claim 7, wherein said quick release mechanism comprises a spring loaded arm holding one of said idler wheels.

9. The blade sharpening system of claim 8, wherein said quick release mechanism comprises an L-shaped pin arranged in said vertical section of said L-shaped support wherein one leg of said L-shaped pin extends over said grinding wheel.

10. The blade sharpening system of claim 9, further comprising:

h) an adjustable blade holding system configured to draw an external blade to be sharpened across said abrasive sharpening surface of said grinding wheel.

11. A blade sharpening system including a grinding device, and a blade holding system, said blade holding system comprising:

a) three multiple hinged arms configured to draw an external blade across an interior surface of said grinding device by folding and unfolding by pivoting around at least one common vertical axis;

b) a cam vertically arranged between at least two of said hinged arms, one said at least one common vertical axis, wherein said cam causes a change in angle of attack between said external blade and said grinding device; and, c) a support system for said hinged arms and said grinding device.

12. The blade sharpening system of claim 11, wherein said support system comprises a horizontal section and a vertical section.

13. The blade sharpening system of claim 12, wherein said blade holding system is adjustably mounted on said horizontal section of said L-shaped support structure.

14. The blade sharpening system of claim 13, wherein said grinding device is an open grinding wheel having an abrasive interior surface and said open grinding wheel being mounted on said vertical section, said open grinding wheel being arranged to extend above said vertical section.

15. The blade sharpening system of claim 14, wherein said blade holding system is adjustably mounted on said vertical section of said L-shaped support, and extends above said vertical section.

16. The blade sharpening system of claim 15, wherein said blade holding system comprises at least one spring between at least two of said hinged arms.

17. The blade sharpening system of claim 16, wherein said blade holding system comprises a adjustable blade clamp on a distal end of a top hinged arm opposite a hinge with an adjacent arm.

18. The blade sharpening system of claim 17, wherein said blade clamp is adjustable to provide multiple angles of incidence between an external blade being held and said abrasive interior surface of said grinding wheel when said hinged arms are extended in a first position.

19. The blade sharpening system of claim 18, wherein said angle of incidence changes as said hinged arms are folded to a second position, drawing said blade across said interior abrasive surface of said grinding wheel.

20. The sharpening system of claim 19, wherein said cam operates to change said angle of incidence when said hinged arms move with respect to each other.

* * * * *